US010744386B1

(12) United States Patent
Overby

(10) Patent No.: US 10,744,386 B1
(45) Date of Patent: Aug. 18, 2020

(54) SWING TRAINING DEVICE

(71) Applicant: Steve Overby, Winston-Salem, NC (US)

(72) Inventor: Steve Overby, Winston-Salem, NC (US)

( * ) Notice: Subject to any disclaimer, the term of this patent is extended or adjusted under 35 U.S.C. 154(b) by 0 days.

(21) Appl. No.: 16/842,093

(22) Filed: Apr. 7, 2020

Related U.S. Application Data

(63) Continuation-in-part of application No. 16/183,885, filed on Nov. 8, 2018.

(51) Int. Cl.
*A63B 69/00* (2006.01)
*A63B 59/51* (2015.01)
*A63B 60/00* (2015.01)

(52) U.S. Cl.
CPC ..... *A63B 69/0002* (2013.01); *A63B 59/51* (2015.10); *A63B 2060/0085* (2015.10); *A63B 2069/0008* (2013.01)

(58) Field of Classification Search
CPC . A63B 69/0002; A63B 59/51; A63B 2102/18; A63B 2060/0085; A63B 2069/0008
USPC ..... 473/422, 437, 457, 519, 520, 564–568
See application file for complete search history.

(56) References Cited

U.S. PATENT DOCUMENTS 439,996 A * 11/1890 Bissell ..... A63B 69/0002 473/457
537,927 A * 4/1895 Kennedy ..... A63B 60/54 473/457
1,616,377 A * 2/1927 Knight ..... A63B 53/007 473/295
2,158,211 A * 5/1939 Aitken ..... A63B 69/3632 473/220
3,030,837 A * 4/1962 Chartier ..... B21D 1/06 29/275
4,214,751 A * 7/1980 Simpson ..... A63B 59/00 473/457
5,011,145 A * 4/1991 Bartkowicz ..... A63B 60/20 473/568
5,839,983 A * 11/1998 Kramer ..... A63B 60/12 473/568
6,406,387 B1 6/2002 Ryan
7,297,077 B1 11/2007 Battaglino
7,794,340 B2 * 9/2010 Mauer ..... A63B 15/00 473/457
8,187,124 B2 * 5/2012 Ciesar ..... A63B 69/0002 473/457
8,827,846 B2 * 9/2014 Shocklee ..... A63B 69/0002 473/453

(Continued)

*Primary Examiner* — Mitra Aryanpour
(74) *Attorney, Agent, or Firm* — Sanchelima & Associates, P.A.; Christian Sanchelima; Jesus Sanchelima

(57) ABSTRACT

The present invention discloses a swing training device for enabling a user to learn a proper swing. The swing training device comprising a barrel, a handle having a first handle portion and a second handle portion and an extender device coupling the first handle portion and the second handle portion. The swing training device is configured to enable a user to achieve proper swing mechanics through feedback or diagnosis and correction of an individual user's swing. The swing training device further configured enable the user to establish muscle memory in the correct batting position so that the user would be able to assume the proper position and execute the swing consistently with proper swing mechanics.

12 Claims, 3 Drawing Sheets

(56) References Cited

U.S. PATENT DOCUMENTS 9,700,776 B2 * 7/2017 Shocklee ..... A63B 69/0002

* cited by examiner

SWING TRAINING DEVICE

OTHER RELATED APPLICATIONS

The present application is a continuation-in-part of pending U.S. patent application Ser. No. 16/183,885, filed on Nov. 8, 2018, which is hereby incorporated by reference.

BACKGROUND OF THE INVENTION

Field of the Invention

The present disclosure relates to a sport training device. More specifically, the present disclosure relates to a swing training device configured to enable a user to achieve proper bat swing and to establish muscle memory in the correct batting position to maintain consistency.

Description of the Related Art

Teaching a person to swing a bat is a very daunting task. It requires years of practice and training with an experienced batting coach to perfect the person's swing. Also, the difficulty of teaching increases or decreases based on circumstances such as natural talent for hitting, terrific vision, eye-hand coordination. Further, proper swing mechanics encompasses a number of techniques and mechanics such as proper hand placement and body movement, optimal bat acceleration, and ample power to hit the ball.

Several devices have been designed in the past to improve bat mechanics for bat swinging and hitting skills. None of them, however, include a device that is capable to provide a fool proof method for learning how to hit and being able to do it consistently with power.

Applicant believes that a related reference corresponds to U.S. Pat. No. 6,406,387 filed by Richard L. Ryan describes a baseball practice bat. The Richard reference teaches a baseball practice bat comprising: a main bat barrel, a slidable handle portion, a non-moving aluminium handle portion, a centrally located shaft running through said main bat barrel, said slidable handle portion and said non-moving handle portion. The bat further comprises a non-pinch flange located on the bottom of said slidable handle, said flange having a downwardly facing post. Further, said flange on said non-moving handle comprises a rubber washer attached, said washer having a cut out area where said downwardly facing post can penetrate and contact the metal portion of said non-moving handle. Further, molded finger positioning grips affixed to said sliding handle portion and said non-moving handle portion that helps the user align his or her knuckles on both hands. The Richard reference helps the user to learn how to keep his or her knuckles aligned on the bat during the swing. However, the Richard reference lacks to provide a foolproof method for proper swing mechanics for learning swinging and hitting skills.

Another related reference is U.S. Pat. No. 7,297,077 filed by Robert Battaglino discloses a bat exercise, practice, and training device. The Robert reference teaches an exercise, practice, and training device comprising a transition piece adjustably connected to a distal end of a handle. An action receiving element is bendably connected to a distal portion of the transition piece and extends distally therefrom. The action receiving element is also connected to the transition piece by a biasing element that biases the action receiving element into alignment with the transition piece and enables bending during exercise, practice, and training by the user.

Similar to Richard reference, the Robert reference also lacks to provide a fool proof method for learning swinging and hitting skills.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a swing training device for enabling a user to obtain a proper swing with proper swing mechanics.

It is also an object of the present invention to provide a swing training device which helps to improve hand and eye coordination.

It is another object of the present invention to provide a swing training device for enabling the user to achieve a proper bat swing through diagnosis, feedback and correction of an individual user's swing mechanics.

It is yet another object of the present invention to provide a swing training device for enabling the user to establish muscle memory in the correct batting position so that user would be able to assume the proper position and execute the swing mechanics consistently.

It is yet another object of the present invention to provide a swing training device comprising a barrel, a handle having a first handle portion and a second handle portion and an extender device coupling the first handle portion and the second handle portion.

It is yet another object of the present invention to provide a swing training device configured to separate first handle portion and second handle portion during the swing, indicating whether the user's swing is correct.

It is another object of the present invention to provide a swing training device which helps to improve the self-image and confidence of the user with higher performance consistency achieved with proper swing mechanics.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
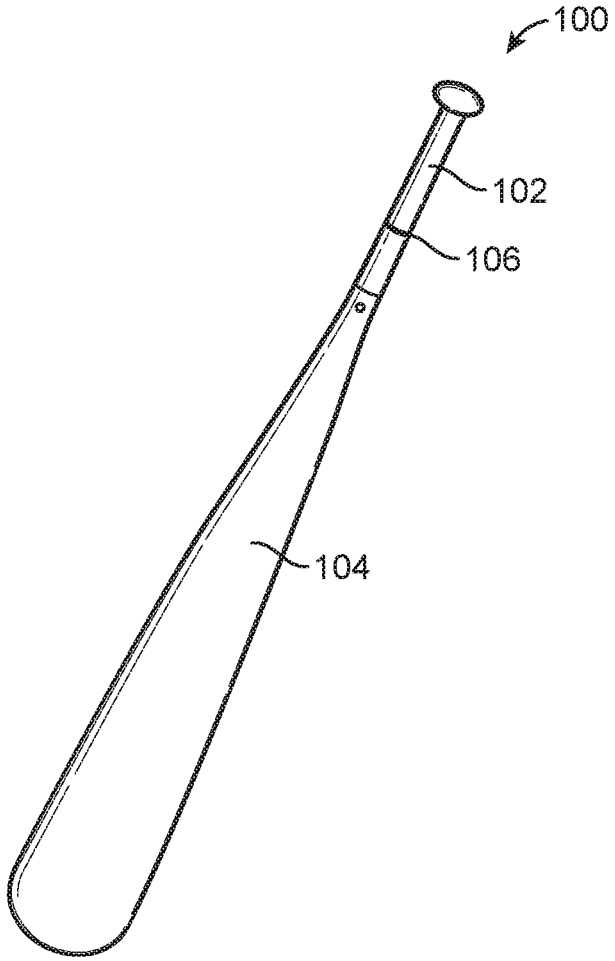
FIG. 1 exemplarily illustrates a perspective view of a swing training device 100 in an embodiment of the present invention. The swing training device or swing training bat 100 comprising a barrel 104, a handle 102 and an extender device 106, is illustrated.
Figure 2:
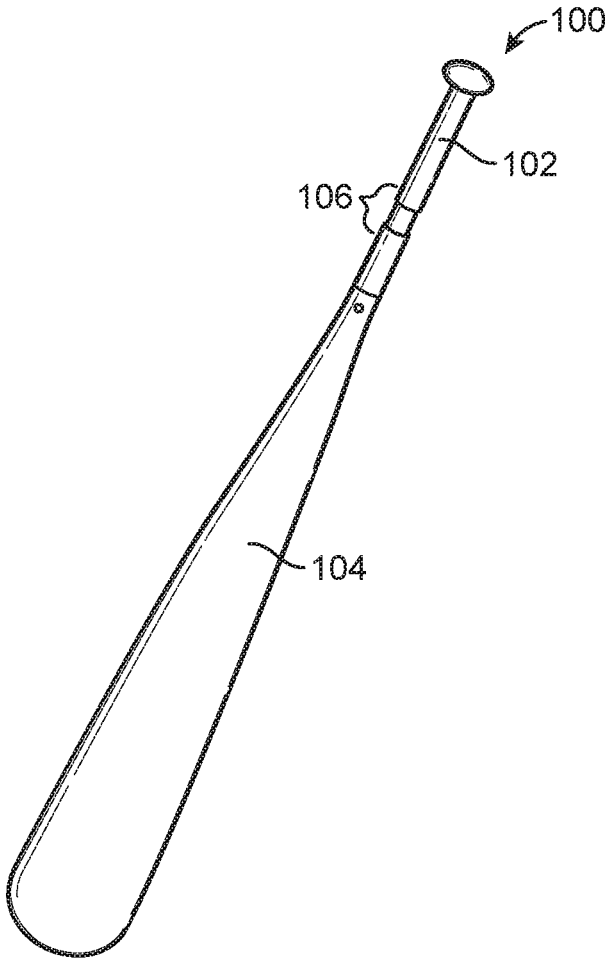
FIG. 2 exemplarily illustrates separation of handle 102 of the swing training device 100, according to an embodiment of the present invention.
Figure 3:
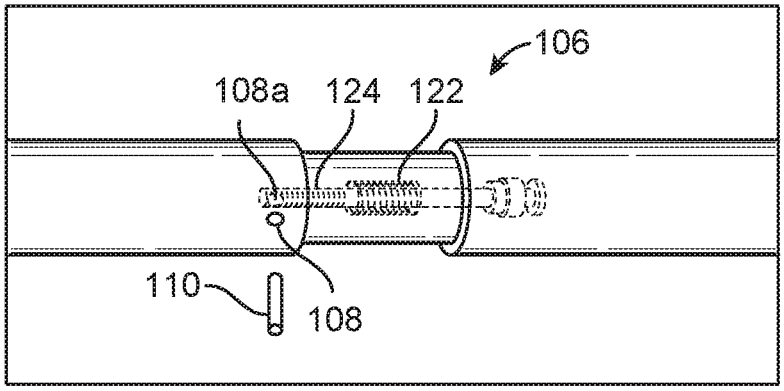
FIG. 3 exemplarily illustrates the extender device 106 in an embodiment of the present invention. The extender device 106 separating a first handle portion and a second handle portion of the user, is illustrated.
Figure 4:
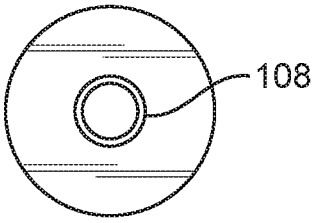
FIG. 4 exemplarily illustrates a through hole 108 on the second handle portion in an embodiment of the present invention.
Figure 5:
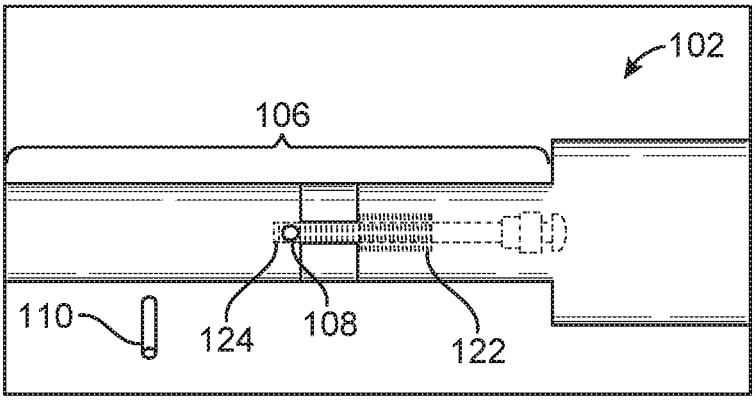
FIG. 5 exemplarily illustrates the handle 102 of the swing training device 100 in an embodiment of the present invention.
Figure 6:
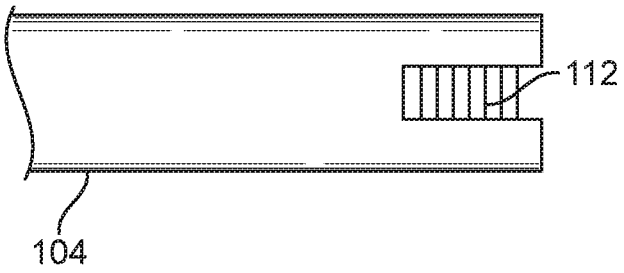
FIG. 6 exemplarily illustrates a threaded through hole 112 on the second handle portion in an embodiment of the present invention.

Referring now to the drawings, FIGS. 1-7, where the present invention is generally referred with numeral 100, it can be observed that a swing training device or swing training bat 100 to obtain proper hitting and swinging mechanics, is disclosed. The device 100 configured to enable a user to obtain consistent swing mechanics. The swing training device 100 further configured to enable the user to achieve proper bat swing through feedback or diagnosis and correction of an individual user's swing. The swing training device 100 further configured to enable the user to establish muscle memory in the correct batting position so that user would be able to assume the proper position and execute the swing consistently.

The device 100 comprises a barrel 104, a handle 102 and an extender device 106. The handle 102 comprises a first handle portion and a second handle portion. The extender device 106 couples the first handle portion and the second handle portion. The second handle portion of the handle 102 and the barrel 104 is a unitary body. In one embodiment, the device 100 further comprises a metal receiver, a collar and metal base receiver. In one embodiment, the second handle portion comprises a through hole 108 to receive a pin or movable member 110 therein. In another embodiment, the through hole 108 is a threaded through hole 112.

The barrel 104 of the device 100 is adapted to rotate, and the first and second handle portion of the handle 102 is adapted to separate via the extender device 106 during a swing. The separation of the hands during the swing provides instant feedback as to when the swing is breaking down. The separation of the handle 102 indicates whether the user's swing is correct. When the user swings the device 100 properly, the device 100 is configured to accelerate at impact with the ball, and then slows as rotation starts the breakdown process.

Further, failure of separation of handle 102 indicates improper swinging of bat 100, providing instant feedback. Hence, the device 100 enables the user to initiate each swing from the same location, enables the user to release hands to the ball in the same way as that of each swing and maintains hands in same position as they move to the ball allowing the bat 100 to rotate hands after impact with the ball. The goal of each swing is to get the bat 100 and ball in the same path going in opposite direction at impact. Further, hands should travel the shortest distance possible to the ball. Thus, repeating and maintaining the proper swing improves consistency.

The extender device 106 is then mounted and secured into the knob handle and the barrel end. The extender device 106 may be spot welded, or milled and pressed into the knob handle and the barrel end. Therein extender device 106 may be a tensioning member 122 and a threaded moving member 124. In one embodiment, tensioning member 122 may be a spring. Tensioning member 122 may be raveled around threaded moving member 124. Threaded moving member 124 has a distal end that is circular on a lower portion thereof. Threaded moving member 124 has a smooth middle portion. Threaded moving member 124 has a threaded upper portion. The lower portion of threaded moving member 124 includes a circular stopper piece thereon. Threaded moving member 124 may further include a threaded member hole 108*a* to receive movable member 110 therethrough. Moveable member 124 may provide more stability to the present invention. Movable member 110 may cooperate with both of through hole 108 and threaded member hole 108*a*, simultaneously. The spring loads as the barrel 104 rotate during the swing and separates the user or hitter's hands. The barrel 104 extends to the point that the hands of the user separate. When the swing speed of the bat 100 decreases, the extender device 106 recoils bringing the hitters hands to back together. In one embodiment, the extender device 106 retracts if the barrel 104 of the bat 100 rotates which indicates that the swing is breaking down and also slowing down in speed. Thus, the device 100 provides immediate feedback indicating whether if it was a proper swing.

In one embodiment, the process of practice using the device 100 is disclosed. The sequence involves, watching the ball from pitcher's hand until it becomes visible, and when the ball comes in focus, the user turns the hip and pushes the top hand to the spot where the ball becomes visible. The process of turning the hips and pushing the top hand to the balls creates an opportunity for angular momentum to the ball. It shortens the swing and the amount of time the swing takes. The handle 102 separates as the momentum of the barrel 104 of the bat 100 approaches the ball.

During separation of handle 102 the front arm become straight, the back arm and hand continue to straighten out. The hitter or user utilizing the device 100 feels the separation and could work on recreating that feeling with every swing. The extension of bat 100 provides more bat speed with less effort. A longer pendulum assures more energy into the ball. The device 100 helps the hitter to learn to create power and consistency with each swing.

More energy is transferred into the ball when the bat 100 and ball area traveling in opposite direction at impact. This type of collision is called a head-on collision. If the hitter's bat is accelerating at the impact even more energy is transferred into the ball. By extending the back or dominate hand and arm to the ball, a head-on collision happens naturally when the ball is within the focal length of the hitter's eyes. On realization of hitting the ball in short time, with maximum bat control increases consistency in performance, increases confidence, and enables to access both the hitter's power and the pitcher's power.

In one embodiment, the bat 100 could be of any weight or length. In one embodiment, the device 100 is made of rigid materials such as aluminum, wood, carbon fiber or the like. It is to be understood that the present invention is not limited to any particular dimensions, weight or materials. The present invention may be made to accommodate and cooperate with users of different sizes.

Advantageously, the device 100 enables the user to achieve consistency, increases confidence of the user, access both the hitter's power and the pitcher's power, eliminates the need to speed swing up, enables to learn proper angle of attack, and provides both positive and negative feedback. The device 100 could be used by kids, adults, baseball or softball players or anyone interested in learning proper hitting and swinging mechanics. It is to be understood that the device 100 may be implemented into other sports equipment such as tennis rackets, golf clubs, or hockey sticks. The device 100 may be implemented into sports equipment requiring two handed usage.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A swing training device, comprising:

a bat having a barrel and a handle, wherein the handle includes a first handle portion and a second handle portion; and an extender device coupling the first handle portion and the second handle portion of the handle, said extender device indicating whether proper or improper swing mechanics are exhibited upon swinging of said bat, the extender device includes a tensioning member and a threaded moving member therein, said tensioning member being a spring that is raveled around said threaded moving member, said tensioning member being fully expanded upon said first handle portion and said second handle portion being in contact with each other, said threaded moving member extends from said first handle portion and entirely through said extender device and engages said second handle portion through a through hole thereof located at a bottom of said second handle portion, said threaded moving member extends partially through said first handle portion at an upper portion thereof, said threaded moving member also extends entirely through said extending device and partially through said second handle portion at a lower portion thereof, wherein the barrel rotates when said proper swing mechanics are exhibited, said tensioning member loads as said barrel rotates causing the first handle portion and the second handle portion to separate via the extender device during a proper swing of said bat, said first handle portion and said second handle portion remain in line with one another even as separation of said first handle portion and second handle portion occurs, when said improper swing mechanics are exhibited said first handle portion and said second handle portion remain in contact, after separation of said first handle portion and said second handle portion said tensioning member returns to full expansion as said barrel stops to rotate thereby bringing said first handle portion and said second handle portion back together.

2. The device of claim 1, wherein the second handle portion and the barrel are a unitary body.

3. The device of claim 1, wherein the second handle portion includes a threaded end.

4. The device of claim 1, wherein the separation of the handle increases the speed of the swing.

5. The device of claim 1, wherein the device is made of aluminum.

6. The device of claim 1, wherein the extender device is milled and pressed between the first handle portion and the second handle portion.

7. The device of claim 1, wherein the extender device extends and separates the first handle portion and the second handle portion upon rotation of the barrel.

8. The device of claim 1, wherein said extender device is entirely in between the first handle portion and the second handle portion.

9. The device of claim 1 wherein said threaded moving member having a circular distal end, a smooth middle portion and a threaded upper portion, said smooth portion further having a circular stopper mounted thereon.

10. The device of claim 9, wherein said barrel includes a through hole and said threaded moving member includes a threaded member hole.

11. The device of claim 10, wherein a pin is inserted and entirely receive within said threaded member hole and said through hole to provide stability to said bat.

12. A swing training device, comprising:

a bat having a barrel and a handle, wherein the handle includes a first handle portion and a second handle portion, a user's hands are placed on and grip said handle, one of the user's hands grips said first handle portion and the other of the user's hands grips said second handle portion, said user's hands being in contact with one another when said first handle portion and said second handle portion are in contact; and an extender device coupling and entirely in between the first handle portion and the second handle portion of the handle, said extender device indicating whether proper or improper mechanics are exhibited upon swinging of said bat, wherein the extender device includes a tensioning member and a threaded moving member therein, said tensioning member being a spring that is raveled around said threaded moving member, said tensioning member being fully expanded upon said first handle portion and said second handle portion being in contact with each other, said threaded moving member extends from said first handle portion and entirely through said extender device and engages said second handle portion through a through hole located at a bottom of said second handle portion, said through hole being threaded, said threaded moving member extends partially through said first handle portion at an upper portion thereof, said threaded moving member also extends entirely through said extending device and partially through said second handle portion at a lower portion thereof, wherein the barrel rotates if proper swing mechanics exhibited, said tensioning member loads as said barrel rotates leading the first handle portion and the second handle portion to separate via the extender device during proper swinging of said bat, said user's hands also separate when said proper swing mechanics are used, said first handle portion and said second handle portion remain in line with one another even as separation from one another occurs, when said improper swing mechanics are exhibited said first handle portion and said second handle portion remain in contact and the user's hands remain in contact as well, after separation of said first handle portion and said second handle portion said tensioning member returns to full expansion as said barrel stops to rotate thereby bringing said first handle portion and said second handle portion back together.

* * * * *